US006827490B2

(12) United States Patent
Baker

(10) Patent No.: US 6,827,490 B2
(45) Date of Patent: Dec. 7, 2004

(54) PREOPENED BAGS FOR AUTOMATED BAGGERS AND RELATED METHODS

(75) Inventor: Tony D. Baker, Hudson, OH (US)

(73) Assignee: Advanced Poly-Packaging, Inc., Akron, OH (US)

( * ) Notice: Subject to any disclaimer, the term of this patent is extended or adjusted under 35 U.S.C. 154(b) by 0 days.

(21) Appl. No.: 10/086,961

(22) Filed: Mar. 4, 2002

(65) Prior Publication Data

US 2003/0165278 A1 Sep. 4, 2003

(51) Int. Cl.[7] ..... B65D 30/10
(52) U.S. Cl. ..... 383/37; 383/9
(58) Field of Search ..... 383/37, 67, 9, 383/109; 53/469, 479

(56) References Cited

U.S. PATENT DOCUMENTS 2,628,013 A 2/1953 Vogt
2,667,997 A 2/1954 Vogt
2,671,588 A 3/1954 Vogt
2,775,082 A 12/1956 Vogt
2,884,988 A * 5/1959 D'Angelo ..... 156/352
3,779,449 A * 12/1973 Membrino ..... 383/35
3,939,972 A * 2/1976 Mayworm ..... 206/219
4,756,144 A * 7/1988 Jostler ..... 53/568
4,863,285 A * 9/1989 Claxton ..... 383/37
4,945,713 A * 8/1990 Widenback ..... 53/459
5,221,567 A * 6/1993 Baker ..... 428/43

* cited by examiner

*Primary Examiner*—Jes F. Pascua
(74) *Attorney, Agent, or Firm*—Renner, Kenner, Greive, Bobak, Taylor & Weber

(57) ABSTRACT

A web of bags for use in an automatic bagging machine is formed from a single layer of plastic film or a flattened tubular plastic film. When formed from the tubular material, the bags are doubled walled. The bags have lateral slits therein to accomodate opening of the bags in an automatic bagger. The bags are further configured to be received upon a track having an expandable portion that laterally displaces the bags in the web, causing them to open beneath a filling head for receipt of articles. A latter portion of the track allows the bags to resume their normally closed posture, where they are sealed and separated from each other.

6 Claims, 3 Drawing Sheets

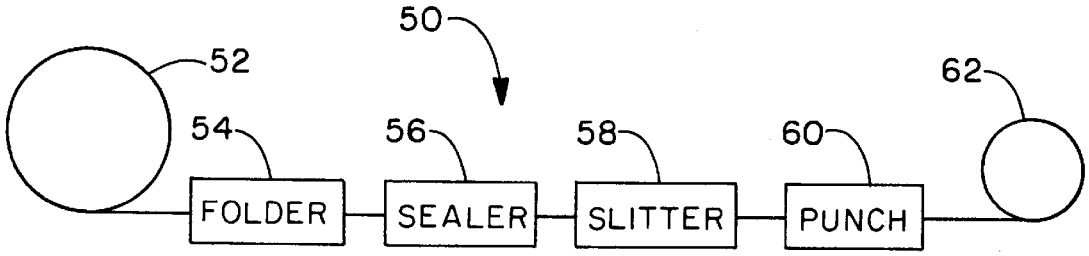
FIG.-2
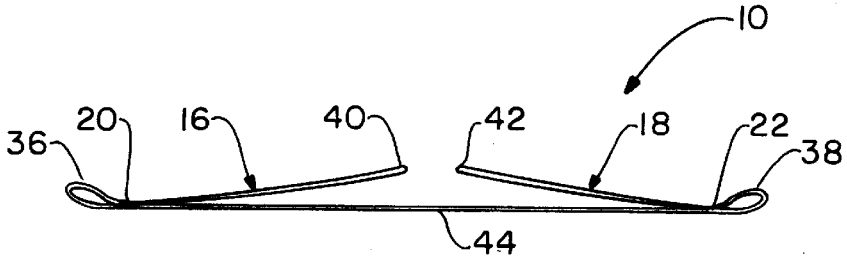
FIG.-3a
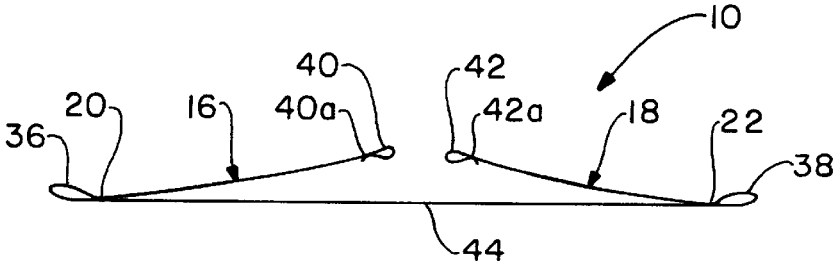
FIG.-3b
FIG.-4a
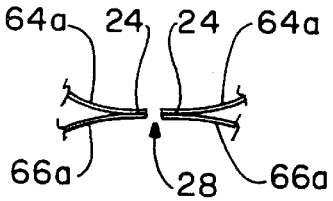
FIG.-4b
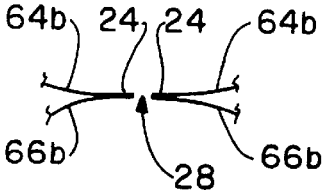

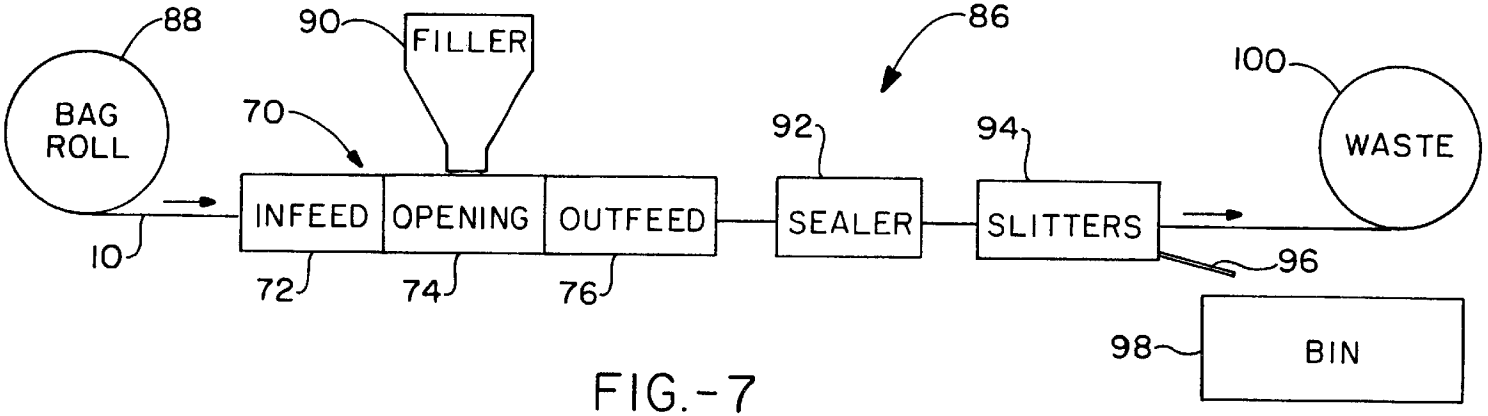
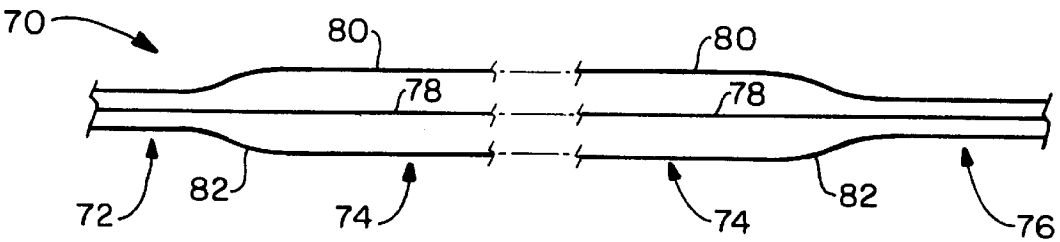
FIG.-7
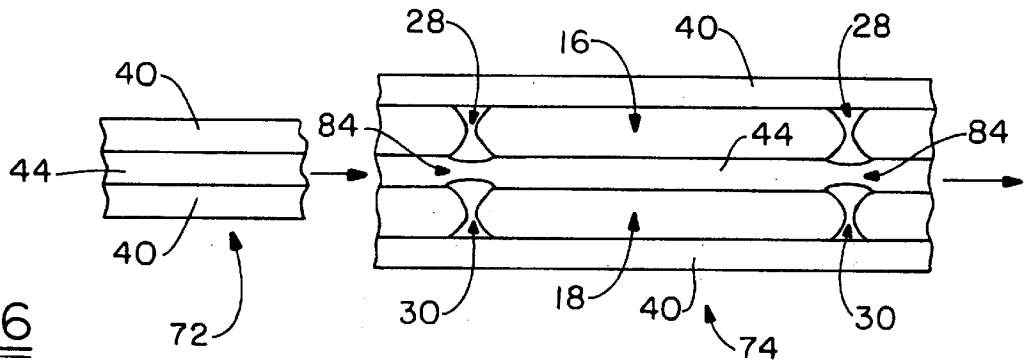
FIG.-5
FIG.-6

PREOPENED BAGS FOR AUTOMATED BAGGERS AND RELATED METHODS

TECHNICAL FIELD

The invention herein resides in the art of automated bagging machines and particularly to the webs or rolls of bags used therein. Specifically, the invention relates to a web of preopened laterally disposed bags maintained in a web suitable for use in automated bagging equipment and to such a bag that is dual walled to provide enhanced strength over previously known bags. The invention further relates to a method for making bags of the type disclosed herein and for packaging articles employing such bags.

BACKGROUND ART

The use of automated bagging machines or automatic baggers has become commonplace. Such machines typically employ a web of bags, dispensed from a roll or box, that are preopened and sequentially positioned beneath a filler head for receipt of appropriate articles or the like. However, the bags employed in such automated baggers have been fraught with various difficulties in use.

Although automated baggers have evolved to a rather compact nature, it is still customary that a bagger is capable of handling but a single bag at a time, sequentially indexing single bags to the filling head. When demand requires that more bags be handled in a given period of time, additional baggers are typically added. Such baggers add to the cost of production, may require additional attendant personnel, and consume additional floor space. While the speed of operation of automated baggers may increase, delaying the onset of such problems, there is a need in the art for automatic baggers and bags therefore that accomodate the dual filling of bags, rather than in singular fashion.

There is also a need in the art for increased strength in plastic film bags typically employed in automatic baggers. There is further a desire to provide bags which are not only of enhanced strength, but which provide a degree of safety against punctures or tears.

Still a further problem with prior art bags are the difficulties incident to manipulating the bags in an automatic bagger. Particularly troublesome is the ability to open the bag at the filling head sufficiently to receive a full complement of articles in a time effective manner, while reducing any likelihood of the articles missing the open bags as they are released from the dispensing head.

DISCLOSURE OF INVENTION

In light of the foregoing, it is a first aspect of the invention to provide preopened bags for automated baggers that are in a saddlebag configuration.

Another aspect of the invention is to provide preopened bags for automated baggers that are of enhanced strength, being of a dual wall construction.

Yet a further aspect of the invention is the provision of preopened bags for automated baggers in which the bags in the web are separated from each other and have longitudinal splits at the mouths thereof to accomodate effective and efficient opening of the bags during the filling operation.

Still a further aspect of the invention is the provision of preopened bags for automated baggers in which two bags can be filled simultaneously and in which the bags are filled from the bottom.

Still a further aspect of the invention is the provision of preopened bags for automated baggers which may be formed from either a single layer web of film or a flattened tubular film.

Still a further aspect of the invention is the provision of a track to accomodate bags of the aforesaid nature and to achieve an effective opening of the bags at the filler head.

Still an additional aspect of the invention is the provision of a method for making dual walled bags having added strength and safety from tears and the like over previously known bags.

Yet a further aspect of the invention is the provision of a method of bagging articles using bags and tracks of the nature presented above.

The foregoing and other aspects of the invention which will become apparent as the detailed description proceeds are achieve by an assemblage of bags for use in an automated bagging machine, comprising: a continuous web of a pair of laterally opposed rows of bags; lateral cuts extending partially across said bag, said lateral cuts separating said bags from adjacent bags in each of said rows, and defining sides of said bags; and longitudinal cuts, orthogonal to said lateral cuts, traversing each of said sides of said bags, said longitudinal cuts facilitating opening of said bags.

Other aspect of the invention are attained by a method for making a web of interconnected preopened double walled bags, comprising: flattening a tubular film into a continuous double walled sheet; folding sides of said sheet inwardly upon themselves; imparting lateral seals into said sheet at spaced apart locations, said seals defining bags therebetween; imparting lateral cuts through said sheets between said bags within said seals to separate said bags from each other; and imparting longitudinal cuts through said sheet at ends of said lateral cuts.

Yet further aspects of the invention are attained by a method of bagging articles in a continuous web of dual rows of interconnected preopened bags, comprising: feeding the continuous web upon a track that separates the rows and thereby opens the bags within the rows; filling the bags with articles; moving the web upon the track to a point that brings the rows of bags together and thereby closes the bags; sealing the bags at the areas where the articles were deposited therein; separating the bags from each other; and retrieving the remainder of the continuous web as waste.

DESCRIPTION OF THE DRAWINGS

For a complete understanding of the objects, techniques and structure of the invention, reference should be made to the following detailed description and accompanying drawings wherein:

FIG. 2 is an illustrative view of the apparatus and method by which bags of FIG. 1 may be made;

FIG. 3, comprising FIGS. 3*a* and 3*b*, are cross sectional views of the web of bags of FIG. 1 taken along the line 3—3, respectively showing bags of single wall and double walled construction;

FIG. 4, comprising FIGS. 4*a* and 4*b*, taken along the line 4—4 of the web of bags in FIG. 1, respectively show cross sectional features of the dual walled and single wall bags of the invention;

FIG. 5 is an illustrative top plan view of the bag web transport track which may be efficiently and effectively employed with the bags of the invention;

FIG. 6 is an illustrative top plan view of the web of bags of the invention shown mounted upon and transported by the track of FIG. 5; and FIG. 7 is a diagram of the apparatus and method that may employ the bags of the invention in a bagging system.

BEST MODE FOR CARRYING OUT THE INVENTION

Figure 1:
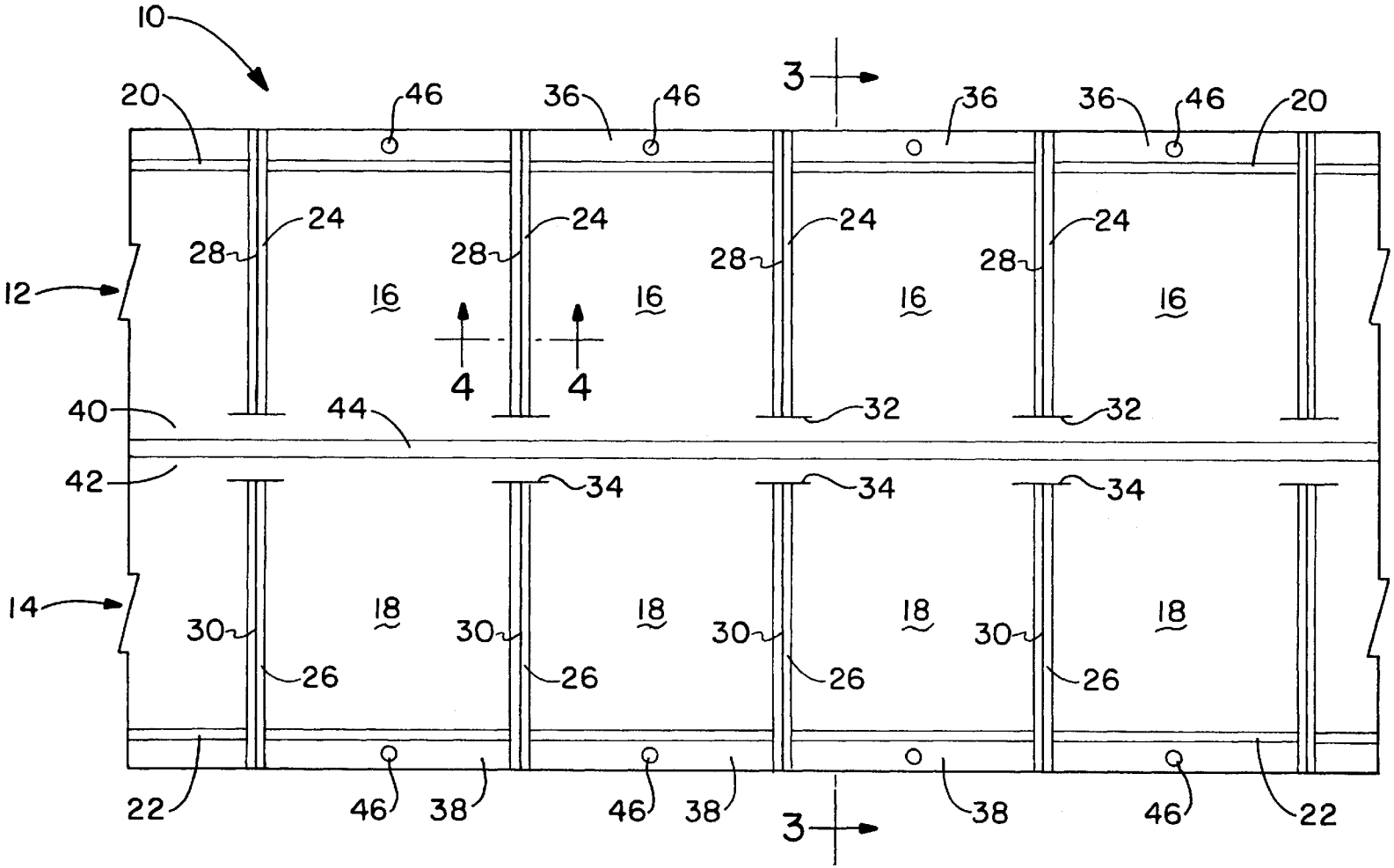
FIG. 1 is a top plan view of a web of bags for use in an automated bagging machine in accordance with the invention.

Referring now to the drawings and more particularly to FIG. 1, it can be seen that a web of preopened laterally disposed bags made in accordance with the invention is designated generally by the numeral 10. The web of bags 10 is formed from a single piece of plastic film and may be either single layered or double layered, as will be presented in detail later herein. The web 10 consists of laterally opposed chains or rows 12, 14 of bags 16, 18. Seals 20, 22 extend longitudinally along the web 10 slightly inboard of the edges of the web to define sealed tops to the bags 16, 18. Those skilled in the art will appreciate that the seals 20, 22, as with the remaining seals disclosed herein, are formed by heat seals. With the web 10 being formed of appropriate plastic film, the heat sealing may be easily imparted by a heated platen, wheel or the like. The sealing is achieved by intermelting of the plastic film layers, achieving a fusing effect.

Side seals 24, 26 extend laterally inwardly from the edges of the web 10 to a point short of the center thereof. The sides seals 24, 26 define the sides of the bags 16, 18. Lateral cuts 28, 30 extend through the center of the seals 24, 26 and pass completely therethrough to sever the sides of the bags 16, 18 from adjacent bags. The lateral cuts 28, 30 end at and preferably intersect with longitudinal cuts 32, 34 which extend inwardly from the side edges of each of the bags 16, 18 a slight distance, such as between 5% and 25% of the bag width. The longitudinal cuts 32, 34 also pass completely through the web 10.

As shown in FIG. 1, top flanges 36, 38 are defined by seals 20, 22 at the tops of the bags 16, 18. Bottom lips 40, 42 extend in parallel opposed fashion along the web 10 at the bottom portion of the bags 16, 18. The bottom lips 40, 42 provide openings to the interiors of the respective bags 16, 18 and, as will become apparent hereinafter, also define receptacles for tracks of an automated bagging machine. The lips 40, 42 overlay a bottom portion of the web 10 and expose therebetween a center connecting web 44. Hang holes 46 may be punched into the top flanges 36, 38, as shown.

Referring now to FIG. 2, an appreciation can be obtained of a system and method for making the web 10. Such is designated generally by the numeral 50. A roll 52 of single layer plastic film, or flattened tubular film if a dual walled bag is desired, provides a web of such material to a folder 54, where side portions of the web are folded inwardly upon themselves, just short of the center of the web as is apparent from reference to FIG. 1. With the web so folded, it passes to the sealer 56 which, as will be appreciated by those skilled in the art, may be a heated roller, die, platen or the like. The sealer 56 imparts the heat seals 20, 22, 24 and 26 to the web, fusing the various layers of the folded web together in the areas as indicated in FIG. 1. Next the sealed web enters a slitter 58, which may comprise roller knives or dies to impart the through cuts 28, 30, 32, 34 as discussed above with respect to FIG. 1. Next, a punch 60, again a rotary member or the like, may form the holes 46 in the flanges 36, 38 in standard fashion. Finally, a take-up roll 62 winds up the finished web of bags 10. It will, of course, be appreciated that the take-up roll 62 is the prime drive member of the system 50.

Referring now to FIGS. 3*a* and 3*b*, an appreciation can be obtained of the cross section of the web 10. FIG. 3*a* illustrates the web 10 when made from a flattened tubular film, thus providing a bag of doubled walled thickness, while FIG. 3*b* illustrates the web 10 when made of a web of single layered plastic film. As shown in FIG. 3*a*, seals 20, 22 define top flanges 36, 38, which are substantially tubular in nature. Similarly, with the double walled assembly shown in FIG. 3*a*, the bottom lips 40, 42 are substantially tubular in nature and provide a receptacle for the track of an automated bagger as will be discussed later herein.

The single layered web 10 of FIG. 3*b* is substantially like that shown in FIG. 3*a*, except for the addition of thermal seals 40*a* and 42*a* along the bottom lips 40, 42 to provide for the necessary tubular or sleeve characteristics of the lips 40, 42 to accomodate use in an automated bagger. Such heat seals 40*a* and 42*a* would necessarily be made either before the folder 54 or within the sealer 56 with an insulating back plate interposed within the web itself to prevent sealing to the back side of the web.

With reference now to FIGS. 4*a* and 4*b*, an appreciation of the lateral separation of the bags 16, 18 from each other within the web 10 can be attained. FIG. 4*a* shows the side seals 24 and lateral cuts 28 associated with the bags 16 as would be existent in a doubled walled bag formed from a flattened tubular plastic web. As shown there, a dual walled front panel 64*a* overlies a dual walled rear panel 66*a* in each of adjacent bags 16, separated by the through cuts 28 at the side seals 24. In FIG. 4*b*, the same structure is shown for a single walled bag, made from a single layered plastic web. For light duty packaging, a single layered bag may be sufficient. However, it has been found that double layered bags, such as those made from flattened tubular plastic film stock, can add strength over bags made from a single layer of double thickness. Moreover, the double wall provides protection, security and integrity even when one of the layers is broken or fails.

Referring now to FIG. 5, an appreciation of the bag web transport track 70 intended for implementation with the web 10 is shown in illustrative top plan view. The track 70 includes an infeed portion 72, an expanding or opening portion 74, and an outfeed or closing portion 76. A center rail 78, generally cylindrical or tubular in nature, extends along the length of the track 70 in straight line fashion. The outer rails 80, 82, however, extend or flair outwardly as they transition from the area 72 to the area 74, and contract or extend inwardly as they transition from the area 74 to the area 76. The track 70 receives and suspends the web 10 as it is transported through an automatic bagging machine. FIG. 6 illustratively shows such suspension from a top plan view. As discussed above, the bottom lips 40, 42 of the web 10 are formed as tubular members or sleeves and receive the track members 80, 82. Similarly, the center connecting web 44, substantially in the lateral center of the web 10, is supported upon the track 78. As the web 10 is drawn along the track 70 and enters the expanding or opening portion 74 thereof, the bottom lips 40, 42 separate from each other, such separation being accommodated by the lateral through cuts 28, 30 in the respective bags 16, 18. This lateral separation of the bags 16 from the bags 18 serves to open the bags between the bottom lips 40, 42 and the center connecting web 44. This opening is accompanied by a slight upward buckling 84 at the center web 44. In other words, the lateral cuts 28, 30 allow for the lateral movement of the bags 16, 18 from each other, with the resultant buckling at 84.

With the web so positioned and with the bags 16, 18 open in the area 74, articles may be deposited into the bags for subsequent sealing and separation from the web 10.

Referring now to FIG. 7, it can be seen that a dual bag filling system or automatic bagger made in accordance with the invention is designated generally by the numeral 86. Here, the web of bags 10 is maintained in the form of a roll 88 and is fed along the track 70 to an infeed portion 72 and thence to the opening portion 74 positioned directly beneath a dual filler 90. The filler 90 may include a blower to assist in opening of the bags 16, 18, if desired. After appropriate materials have passed from the filler 90 into the bags 16, 18, opened at the opening portion 74 of the track 70, the web 10 is drawn to the outfeed portion 76 where the bags resume their naturally closed position and pass to heat sealers 92, such as a heated roller, platen or the like. The bags 16, 18 are there sealed in an area traversing the seals 28, 30 of the respective bags 16, 18. Next, they are indexed to slitters 94, where the bags are slit through the center of the seals imparted by the sealers 92 and are thus separated from the web 10. The separated bags pass downwardly upon a chute 96 and are then received in a bin 98. A take-up roll 100, powered and indexed, retrieves the remaining waste of the web 10.

Thus it can be seen that the objects of the invention have been satisfied by the structures and methods presented hereinabove. A saddlebag type of dual inline web of pre-opened bags has been presented for use in an automatic bagging system having a unique track configured for opening the bags. The bags contain through cuts at lateral positions therealong to facilitate the opening of the bags by the track. Also presented is a unique double walled bag of the same nature just described. The double walled bag adds for extra strength and security.

While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be made to the following claims.

What is claimed is:

1. An assemblage of bags for use in an automatic bagging machine, comprising:

a plastic film providing a continuous web of a pair of laterally opposed rows of bags;

lateral cuts extending partially across said web, said lateral cuts separating said bags from adjacent bags in each of said rows, and defining sides of said bags, wherein side edges of said plastic film are folded inwardly upon themselves and sealed together along said lateral cuts; and longitudinal cuts, orthogonal to said lateral cuts, transversing each of said sides of said bags, said longitudinal cuts facilitating opening of said bags, wherein said lateral cuts intersect said longitudinal cuts.

2. The assemblage of bags according to claim 1, wherein said lateral and longitudinal cuts are continuous and pass completely through said web.

3. The assemblage of bags according to claim 2, further comprising longitudinal seals of said plastic film to itself continuously along lateral edges thereof, said longitudinal seals defining top flanges to said bags.

4. The assemblage of bags according to claim 3, wherein said top flanges have holes passing therethrough for hanging said bags.

5. The assemblage of bags according to claim 1, wherein ends of said side edges are folded upon themselves and sealed to define openings to said bags and receptacles for tracks of an automated bagging machine.

6. The assemblage of bags according to claim 5, wherein said receptacles are spaced apart to expose a center connecting web interconnecting said rows of bags, and providing a support member for the tracks of an automated bagging machine.

* * * * *